US005507428A

United States Patent [19]

Robinson, Jr. et al.

[11] Patent Number: 5,507,428

[45] Date of Patent: Apr. 16, 1996

[54] SELF-LOCKING BOX

[75] Inventors: H. English Robinson, Jr.; M. Lee Jones, both of Atlanta, Ga.

[73] Assignee: Why Wrap? Incorporated, Atlanta, Ga.

[21] Appl. No.: 381,682

[22] Filed: Jan. 27, 1995

[51] Int. Cl.[6] ..... B65D 5/43

[52] U.S. Cl. ..... 229/102; 206/807; 229/148

[58] Field of Search ..... 229/102, 148, 229/198.2; 206/807

[56] References Cited

U.S. PATENT DOCUMENTS

| | | | |
|---|---|---|---|
| 636,806 | 11/1899 | Johnstone . | |
| 916,503 | 3/1909 | Thompson . | |
| 1,108,464 | 8/1914 | Morey . | |
| 1,277,459 | 9/1918 | Myers . | |
| 1,470,141 | 10/1923 | Bryson . | |
| 1,530,644 | 3/1925 | Blandford . | |
| 2,028,677 | 1/1936 | Lupton . | |
| 2,044,701 | 6/1936 | Junkin . | |
| 2,388,288 | 11/1945 | Ringler et al. | 229/198.2 |
| 2,834,531 | 5/1958 | Struble . | |
| 3,040,965 | 6/1962 | Meyers | 229/102 |
| 3,225,914 | 12/1965 | Klein . | |
| 3,233,818 | 2/1966 | Bixler . | |
| 3,451,535 | 6/1969 | Caplan . | |
| 3,462,066 | 8/1969 | Farquhar . | |
| 3,512,823 | 5/1970 | D'Esposito . | |
| 3,949,931 | 4/1976 | Hall . | |
| 4,063,678 | 12/1977 | Hall | 229/102 |
| 4,471,902 | 9/1984 | Skaggs . | |
| 4,516,718 | 5/1985 | Forbes . | |
| 4,535,929 | 8/1985 | Sherman, II et al. | 206/807 |
| 4,752,028 | 6/1988 | Ogura . | |
| 4,765,535 | 8/1988 | Michetti . | |
| 4,830,270 | 5/1989 | Holmes . | |
| 5,350,108 | 9/1994 | Friar . | |

FOREIGN PATENT DOCUMENTS

| | | |
|---|---|---|
| 2375100 | 8/1978 | France . |
| 2504892 | 11/1982 | France . |
| 2846467 | 5/1980 | Germany . |
| 2227731 | 2/1989 | United Kingdom . |

*Primary Examiner*—Gary E. Elkins
*Attorney, Agent, or Firm*—Jones & Askew

[57] ABSTRACT

A box for containing goods during storing, mailing, or shipping. The box has at least one end panel secured to a body panel by a locking tab extendable through a slit in a closure flap of an end panel, so that the end panel cannot be unsecured without providing visible evidence of tampering. The locking tab is foldable for insertion through the slit, after which a surface of the locking tab engages the underside of the flap to prevent withdrawing the locking tab through the slit. Flanges on the locking tab engage the locked box, further preventing withdrawal of the locking tab. The locking tab is joined to the remainder of the box by perforated lines of selective weakness, which tear to provide visible evidence of tampering with the locking tab.

13 Claims, 3 Drawing Sheets

SELF-LOCKING BOX

BACKGROUND OF THE INVENTION

The present invention relates generally to boxes, and more specifically to boxes for storing, mailing, or shipping various articles.

Boxes for storing, mailing, or shipping goods have been known in the prior art. In their simplest embodiment, those boxes comprise several body panels forming the sides of the box, and a pair of end panels connected to one or more of the side panels to close the ends of the box. The end panels usually are secured to the side panels by adhesive tape or the like, to close the box. The end panels may terminate with folded flap portions which are inserted beneath one of the body panels to provide a self-securing closure, but such conventional closures usually are less secure than taping shut the box panels. The conventional box may also feature a plurality of overlapping panels which are secured to each other by means of adhesive to form integral end panels. U.S. Pat. No. 3,512,823 is an example of such a box structure.

In order to provide a somewhat more secure closure mechanism, end panels of boxes have been provided with a tabbed portion along the distal edge thereof. These tabbed portions are simply inserted through a mating slit of substantially the same length located on a side panel of the box, the tab after insertion through the slit being glued to the exterior surface of the side panel. U.S. Pat. Nos. 916,503 to Thompson and 4,752,028 to Ogura disclose such a structure.

In the alternative, such tabs have been provided with leading edges which are longer in dimension than the length of the mating slit so that the tab and side panel around the perimeter of the mating slit provide interlocking abutment surfaces, as shown in U.S. Pat. Nos. 2,834,531 to Struble; 2,028,677 to Lupton; 1,530,644 to Blandford; and 4,516,718 to Forbes, Jr. The end portions of such an elongated tab must be folded upon the center portion thereof to permit inserting the tab through the slit, whereupon the elasticity or "memory" of the corrugated board causes the end portions to revert towards their original portion, thereby providing the interlock. However, the leading edge of the locking tabs taught by these box configurations either protrudes through the slit so that it is exposed outside the box or else only provides marginal interlocking structure. Therefore, the locking tabs may be easily unlocked from engagement with the slit of the box and the top panel removed without leaving any visible evidence of tampering.

Some box manufacturers, therefore, have resorted to a locking tab arrangement whereby the tab is affixed to a box panel so that the tab is inserted into the box through the slit, whereupon the reverted locking tab is inaccessible. The only means of opening the box end panel, therefore, is to tear or sever the locking tab from where that tab joins the side panel of the box, thereby providing visible evidence of tampering. The profile of such panels may be rectangular (U.S. Pat. Nos. 4,830,270 to Holmes; 3,949,931 to Hall; 1,470,141 to Bryson; 1,108,464 to Morey; and 636,806 to Johnstone), crescent-shaped (U.S. Pat. No. 3,451,535), or slightly tapered, although still with a flat leading edge (U.S. Pat. Nos. 3,462,066 to Farquhar; and 4,471,902 to Skaggs). However, these tabs provide a completely straight leading edge when the end portions of the tab are folded onto the center portion thereof, thereby making insertion through the narrow slit difficult. Moreover, the double layered leading edge of the folded tab inevitably becomes slightly separated during the insertion stage, once again providing undesirable abutment between the tab and the slit prior to inserting the tab through the slit.

U.S. Pat. No. 5,350,108, assigned to the owner of the present application, discloses an improved self-locking box. That patent describes a box having at least one panel secured to another panel by a locking tab and slot assembly, so that the secured panel cannot be opened without leaving visible evidence of tampering. To accomplish that locking, the box of the '108 patent includes an end panel having a flap extending into the box. The slot is located in the flap. The locking tab is foldable to fit through the slot, and a terminal portion of the locking tab engages a surface on the interior of the box so as to prevent withdrawing the locking tab. However, there remains at least some possibility that a box with the self-locking structure shown in the '108 patent could be nondestructively opened by a determined person who knew the internal construction of the box and had the time, the tools, and a measure of luck to defeat the lock structure.

SUMMARY OF THE INVENTION

Accordingly, it is an object of the present invention to provide an improved self-locking box.

It is another object of this invention to provide a self-locking box structure which can be easily and quickly assembled for containing an article of merchandise.

Still another object of the present invention is to provide a self-locking box structure having a locking tab insertable through a mating slit to lock the box closed but is not withdrawable without visible damage to the box.

It is yet another object of the present invention to provide a self-locking box that thwarts attempts to tamper with the locking tab of the box.

It is a further object of the present invention to provide a self-locking box having a locking tab that cannot be withdrawn from a mating slit in the box, once inserted through the slit.

Yet another object of the present invention is to provide such a box structure whereupon the assembled box cannot be opened without separating the locking tab from part of the box, thereby providing visible evidence of tampering.

Other objects of the invention, in addition to those set forth above, will become apparent to those skilled in the art from the following disclosure.

Stated in broad terms, a box according to the present invention has at least one end panel connected to a body panel for selectively closing a corresponding end of the box. That end panel has a flap extending on top of an open end of the box and there occupying a location adjacent a body panel of the box. A slit is located in the flap of the end panel, and a locking tab is connected to the body panel adjacent the location occupied by the flap. The locking tab may be selectably inserted through the slit when the box is closed, and a surface of the inserted locking tab abuts the interior of the box, preventing withdrawal of the locking tab. Structure on the locking tab further prevents withdrawing that tab.

Stated in somewhat more detail, boxes according to the present invention have an end panel foldable to close an end of the box. The end panel has a flap extending to overlap an end of a body panel adjacent the open end of the box, when the end panel closes that open end. A slit is formed in the flap of the end panel and overlays an opening in the body panel of the box when the end panel is folded to close the box. The locking tab is connected to the body panel adjacent the overlapping location of the end flap. A first portion of the locking tab is foldable to lie alongside a second portion thereof, with the fold line forming a leading edge of the folded locking tab. That leading edge of the locking tab may be aligned with the slit in the end panel and inserted through the slit. The locking tab partially unfolds within the box, abutting the flap within the closed box and thereby locking the end panel in closed relation with the box. The locking tab includes at least one flange that engages a surface of the body panel as the locking tab is inserted through the slit, preventing withdrawal of the locking tab through the slit independently of the abutment between the partially-unfolded locking tab and the flap surface within the box.

Stated in further detail, part of the locking tab is formed in the body panel and is connected to that panel by a selectably separable region of predetermined weakness. In a preferred embodiment, that selectably separable region comprises perforations along the fold line. The locking tab thus defines an open region in the second body panel when that locking tab is folded to enter the slit in the flap of the end panel. A flange is formed on at least one side of the locking tab, and preferably on both sides of the locking tab, and the flanges resiliently deform against confronting edges of the open region as the locking tab passes through the slit. That locking structure resiliently expands once the locking tab moves past the confronting edges, so as to engage the edges of the open region in the panel and further prevent withdrawing the locking tab from the slit.

The present box preferably includes a secondary end panel extending outwardly from the body panel and foldable to close the end of the box. The secondary end panel thus lies in substantially parallel relation to the end panel when the box is closed, so as to prevent a person from seeing inside the box by bending back the end panel from the end of the closed box.

The selectively separable region connecting the locking tab to the box panel provides a further safeguard against undetected opening of the closed box. The separation strength of that region is chosen so that the locking tab will become separated from the box if subjected to force, whether applied manually or by a tool used in an attempt to gain nonobvious entry to the box.

DETAILED DESCRIPTION OF PREFERRED EMBODIMENT

Figure 1:
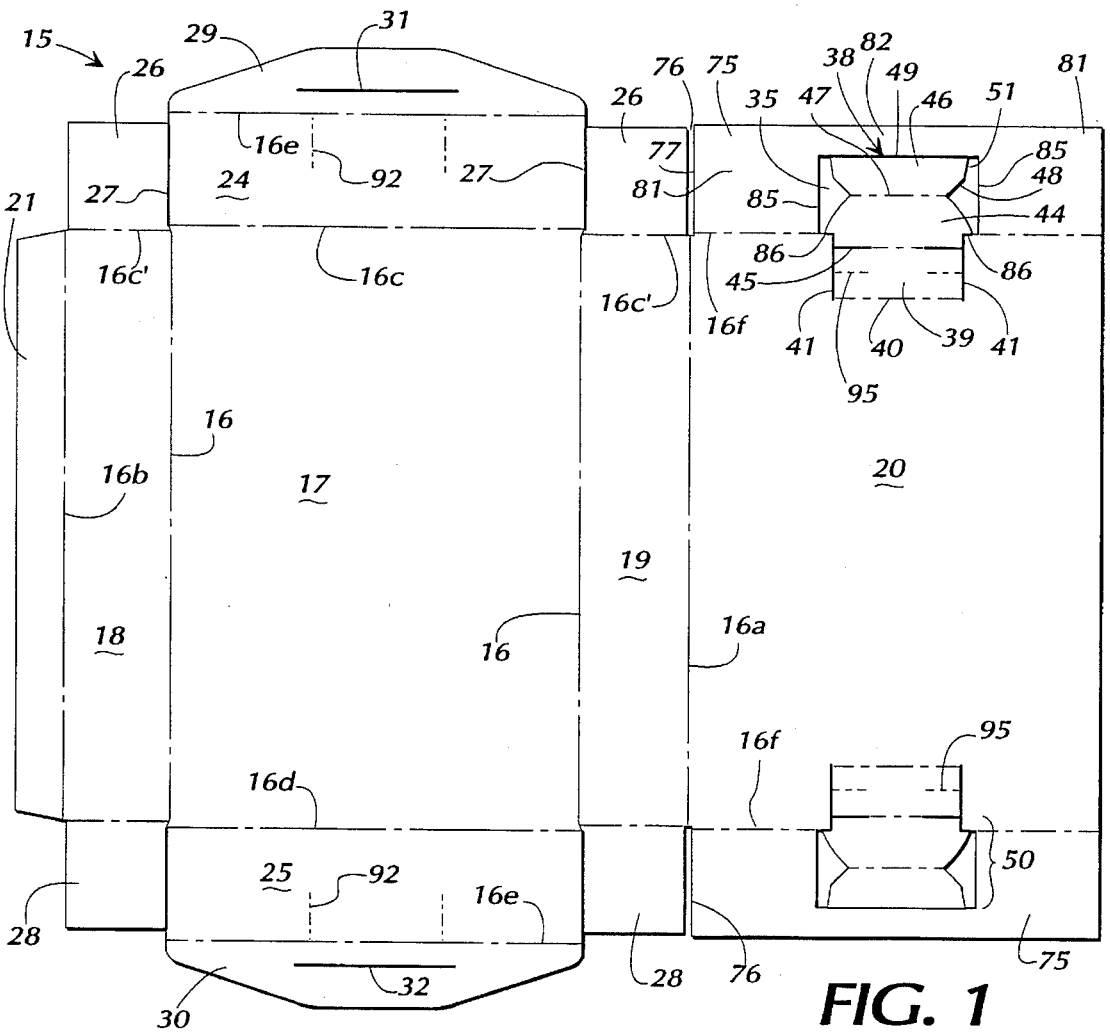
FIG. 1 is a plan view showing a box blank for producing a box according to a preferred embodiment of the present invention.

Turning first to FIG. 1, there is shown generally at 15 a box blank die-cut or otherwise formed from a suitable material such as corrugated board or the like. The box blank 15 includes a number of distinct panels defined by the several score lines 16 formed in the board while forming the blank, in a manner known to those skilled in the art. The distinct panels include the bottom panel 17 flanked by a pair of side panels 18 and 19, and a top panel 20 contiguous to the side panel 19 across the score line 16*a*. A glue flap 21 adjoins the opposite side of the side panel 18, across the score line 16*b* at one edge of that side panel. The box blank 15 may be fabricated from any corrugated or noncorrugated paperboard, or from nonpaper material suitable for box production.

Adjoining the ends of the bottom panel 17 and separated therefrom by the score lines 16*c* and 16*d*, are the two end panels 24 and 25. A pair of corner flaps 26 flank the end panel 24, separated therefrom by the cut lines 27 perpendicular to the score line 16*c* and defining the sides of that end panel. Each corner flap 26 further is defined by the score lines 16*c'*, comprising an extension of the score line 16*c* and also defining ends of the side panels 18 and 19. A second pair of corner flaps 27 likewise is defined flanking the end panel 25 at the opposite side of the box blank 15.

Separate flaps 29 and 30 are formed at the terminal ends of the end panels 24 and 25. The flaps 29 and 30 preferably extend the length of the respective end panels 24 and 25 to provide the most effective closure of the box, as will become apparent. The score lines 16*e* along the end panels 24 and 25, parallel to the respective score lines 16*c* and 16*d* defining the end panels, define the respective flaps 29 and 30. Elongated slits 31 and 32 are formed in the respective flaps 29 and 30, paralleling the longitudinal dimension of those flaps. The slits 31 and 32 preferably are formed as cuts through the material of the box blank 15 without removing any significant amount of that material, and so the slits have minimal width.

The box blank 15 also includes a pair of secondary end panels 75 foldably connected to opposite ends of the top panel 20 by the score lines 16*f* comprising an extension of the score lines 16*c* in the bottom panel 17 and 16*c'* in the side panel 19. The secondary end panels 75 are substantially rectangular and have approximately the same size as the end panels 24 in the preferred embodiment. One end 77 of each secondary end panel 75 lies adjacent a corner flap 26, and an elongated cut 76 separates each corner flap from the adjacent secondary end panel. The width of each cut 76 extends slightly into the end 77 of the secondary end panel 75 to provide clearance for folding the corner flap 26 at a right angle to the secondary end panel, as becomes evident below.

Figure 2A:
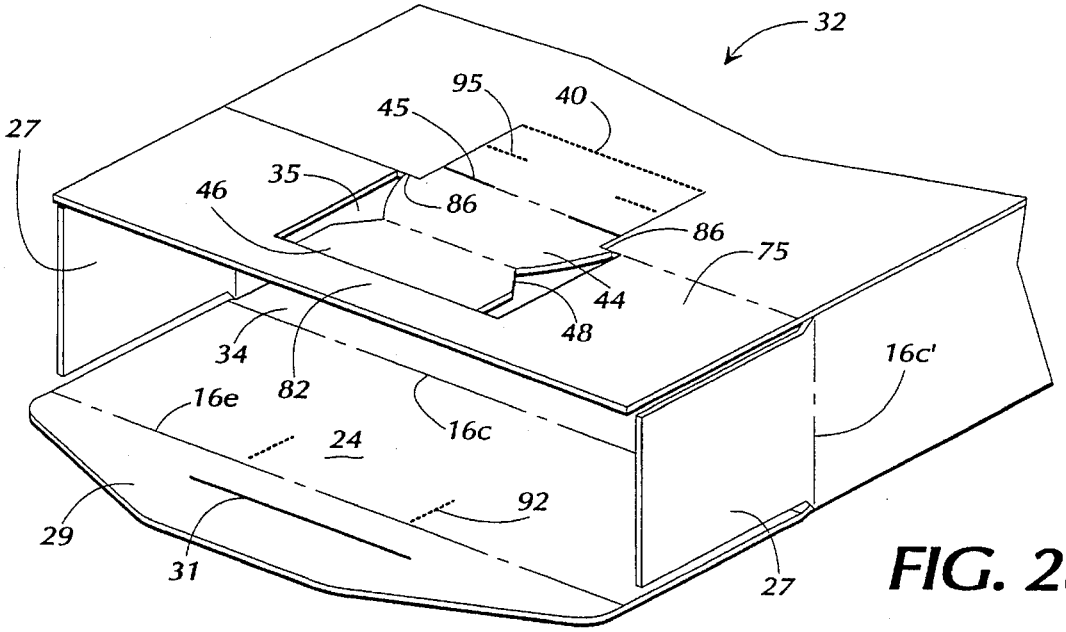
FIG. 2*a*–2*d* are fragmentary pictorial views showing a box assembled from the blank of FIG. 1 and illustrating progressive stages of closing and locking an end panel of the box.

Turning now to FIG. 2*a*, the box 32 shown in that figure is assembled from the box blank 15 by folding the box blank along the score lines 16, 16*a*, and 16*b* so that the bottom panel 17, side panels 18 and 19, and top panel 20 bear an orthogonal three-dimensional relation to each other as shown in that figure. The top panel 20 overlays and is adhesively attached to the glue flap 21 to maintain the assembled configuration of the box 32. The details of fabricating box blanks from corrugated board or other materials, and producing boxes from such blanks, are well known to those skilled in the art and need not be repeated herein.

A central portion of each secondary end panel 75 is cut away to define an open space 35. One pan of a locking tab 38 is located in the open space 35, with the remaining part of the locking tab extending into the adjacent end of the top panel 20. The score line 16*f*, forming an extension of the score line 16*c* and 16*c'*, joins the secondary end panel 75 to the top panel 20 and defines a fold line along which the secondary end panel can fold relative to the top panel.

The locking tab 38 has three distinct segments, starting with a shank 39 located in the top panel 20 and defined by a perforation line 40 in the top panel parallel to the score line 16*f* and set inwardly from that score line. The two parallel cut lines 41, perpendicular to the perforation line 40 and extending outwardly from that line to intersect the fold line 16*f* defining an end of the top panel 20, further define the shank 39. The perforation line 40 defines a hinge that allows the entire locking tab 38 to bend relative to the plane of the top panel 20.

Joining the shank 39 of the locking tab 38 is the central panel 44 defined by the perforation line 45 parallel to the perforation line 40 and inset from the score line 16*f* at the forward edge 36 of the top panel 20 by a lesser distance than the perforation line 40. The line 45 preferably is a score line perforated along part of its length. The use of a partially-perforated score line 45, instead of a score line, to join the central panel 44 to the shank 39 is preferred because those two elements will undergo bending at an acute angle during the locking procedure as explained below.

The shank 39 also has several perforations 95 located on a line between the perforation line 40 and the perforation line 45. The perforations 95, although aligned parallel to the perforation lines 40 and 45, are not intended to define a perforated fold line for folding the shank. However, the perforations do impart a region of structural weakness to the shank 40 between the perforation lines 40 and 45. The central panel 44 extends outwardly from the perforation line 45 and beyond the forward edge 36 of the top panel 20 to join the front panel 46 across the partially-perforated score line 47, parallel to the perforation line 45 and the perforation line 40. The front panel 46 thus is foldable relative to the central panel 44. A V-shaped notch 48 is cut into each side of the central panel 44 and the front panel 46, the apex of each notch coinciding with corresponding ends of the score line 47 separating the front panel from the central panel. The central panel 44 and front panel 46 together form a locking panel 50 (FIG. 1) of the locking tab 38, and the notches 48 help guide the locking panel into the slit 31 of the flap 29 in a manner to be described. As best seen in FIG. 1, the sides 51 of the front panel 46 are flared outwardly toward the terminal end 49 of the front panel, instead of being perpendicular to the terminal end. This outward flare of the sides 51, together with the notches 48 formed between the central and front panels, help assist the locking panel 50 in entering the slit 31 of the flap 29, as described below.

Each locking tab 38 is formed in the box blank 15 by the perforation line 40 and the cut lines 41 in the top panel 20 as mentioned above, and by additional cuts in the secondary end panels 75. The terminal end 49 of the front panel 46 is formed by a cut line parallel to the terminal edge 80 of the secondary end panel, and spaced inwardly a distance from that terminal edge. A strip 82 of the secondary end panel 75, between the terminal end 49 of the locking tab 38 and the terminal end 80 of the secondary end panel itself, thus bridges the open space 35 between the two end portions 81 of the secondary end panel. That bridging strip 82 ensures that the secondary end panel 75 remains a unitary element foldable on the score line 16*f*. The regions between the notches 48 on each side of the locking tab 38, and the confronting sides 85 of the open space 35 in the secondary end panel 75, are cut out as the box blank 15 is produced and remain as open spaces in the secondary end panel.

The space between the two cut lines 41 at the sides of the shank 39 is somewhat less than the corresponding spacing on the central panel 44 along a line contiguous with the fold line 16*f* and the forward edge 36 of the top panel 20. Those different spacings produce the separate flanges 86 on each side of the central panel 44 comprising the locking tab 38. These flanges 86 are contiguous with the forward edge 36 of the end panel 20 and with the fold line 16*f* defining that forward edge. The purpose of the flanges 86 is discussed below.

Figure 2B:
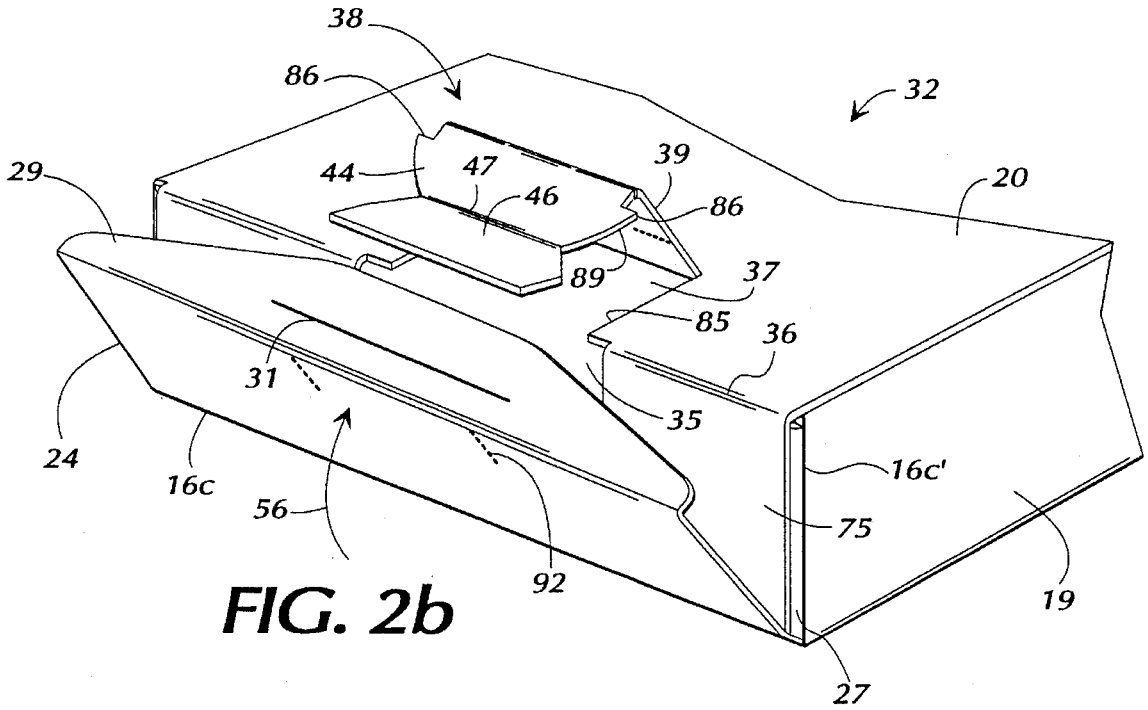
Figure 2C:
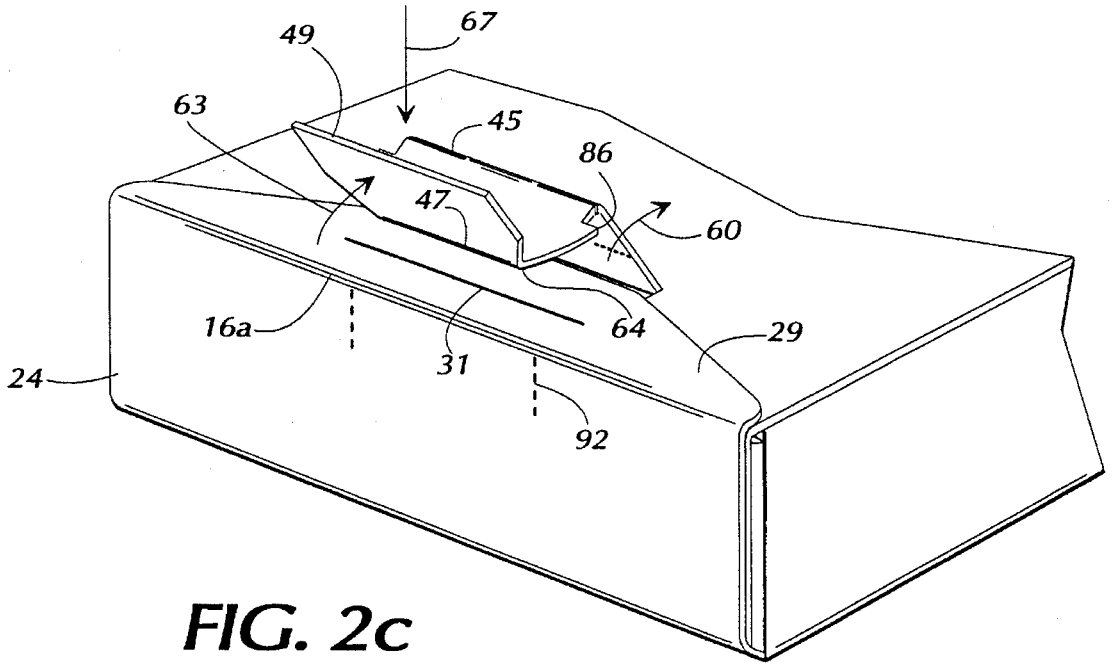
Figure 2D:
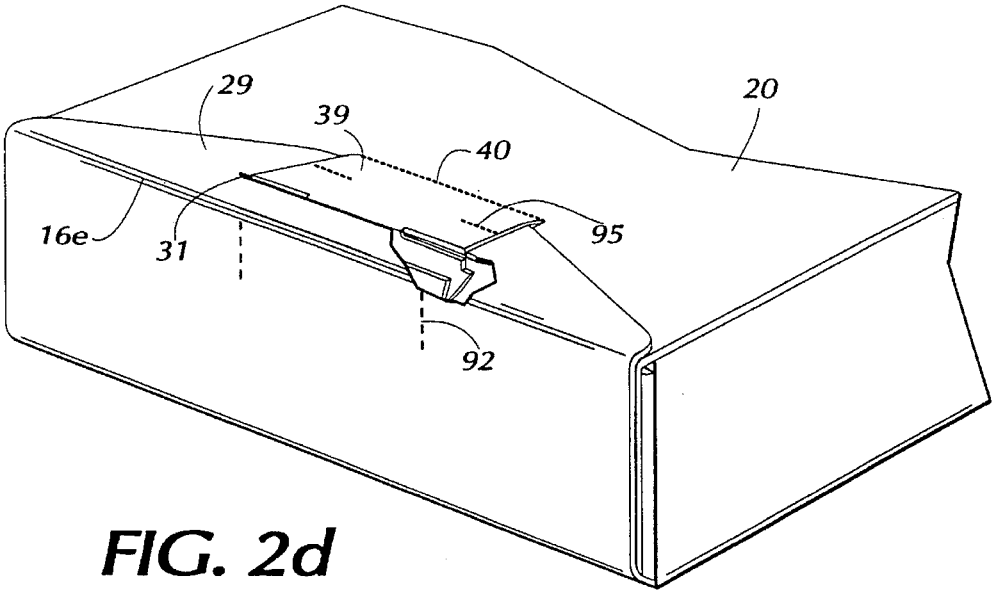

Each end panel 24 contains two parallel sets of aligned perforations 92, best seen in FIGS. 1 and 2*d*. The perforations 92 are perpendicular to the slit 31 in the flap 29 and to the fold line 16*e* separating the end panel 24 and the flap 29, and extend downwardly from a point adjacent to that fold line. The sets of perforations 92 are separated from each other midlength of the end panel 24 slightly less than the length of the slit 31 centrally located on the adjacent flap 29.

After the box 32 is assembled as shown in FIG. 2*a*, that box may be closed and locked as described with initial reference to FIGS. 2*b* and 2*c*. The corner flaps 27 first are turned inwardly 90° around the fold lines 16*c'* to extend across the open end 34 of the box. The secondary end panel 75 then is folded downwardly to the position shown in FIGS. 2*b*, where the secondary end panel covers the corner flaps and the remainder of the open end 34. The locking tab 38 becomes separated from the plane of the secondary end panel 75 as that latter element is folded downwardly. The locking tab 38 may now be turned upwardly around the perforated line 40 to expose the open space 37 in the top panel 20, as shown in FIG. 2*b*, which is contiguous to the open space 35 in the secondary end panel 75. Next, the end panel 24 is folded upwardly around the score line 16*c* as shown by the arrow 56 (FIG. 2*b*) to cover the end 34 of the box 32. The end panel 24 in this position is parallel to the secondary end panel 75 and located immediately in front of that secondary end panel. In this position, the flap 29 of the end panel extends over the forward edge 36 of the top panel 20 and overlaps a forward portion of that top panel, as seen in FIG. 2*c*.

When the end panel 24 is fully closed as shown in FIG. 2*c*, the flap 29 substantially covers the previously-exposed open space 35 in the top panel 20. The locking tab 38 may now be folded back on itself as shown in FIG. 2*c*, by folding the shank 39 rearwardly around the perforated line 40. The arrow 60 in FIG. 2*c* represents that movement. At the same time, the central panel 44 may be folded downwardly along the perforated line 45 to assume a nearly vertical attitude with respect to the top panel 20 and the flap 29. The front panel 46 in this position is folded back along the score line 47 adjoining the central panel 44, so that the outer surfaces of the locking panel 50 comprised by the front panel and central panel move toward each other as shown in FIG. 2*c*. This desired folding movement of the front panel 46 is shown by the arrow 63, FIG. 2*c*. The front panel 46 and central panel 44 thus are folded accordion-fashion into closely-abutting contact with each other, although for illustrative purposes those panels are shown in FIG. 2*c* with greater separation.

With the locking tab 38 thus folded so that the shank 39 is angled upwardly from the top panel 20 and the central and front panels 44 and 46 folded accordion-fashion to contact each other, the perforated line 47 of the locking panel 50 is substantially aligned above the slit 31 in the flap 29 of the end panel 24. The notches 48 on both sides of the locking panel 50 now overlie each other to define the beveled corners 64 at each end of the folded score line 47. By exerting downward force as shown by arrow 67 on the top of the now-folded locking panel, the folded locking panel enters the slit 31 as the shank 39 of the locking tab 38 returns toward a position closely overlaying the end flap 29 and substantially therewith, FIG. 2*d*. The flared sides 51 of the front panel 46 also assist in guiding the locking panel 50 downwardly through the slit 31.

The distance between the perforated line 45 and the perforated line 47 across the locking tab 38 is marginally greater than the corresponding distance between the perforated line 47 and the terminal end 49 of the front panel 46. This difference makes the front panel 46 marginally narrower than the central panel 44. As a result, the terminal end 49 of the front panel 46 becomes located a short distance below the perforated line 45 when the front panel is folded in the direction illustrated by FIG. 2*c* to lie alongside the central panel 44. Thus, the terminal end 49 of the front panel 46 becomes pushed completely through the slit 31 when the locking panel 50 is pushed to the fully-engaged position, shown in FIG. 2*d*, where the shank 39 is substantially parallel with the top panel 20 of the box. When the terminal end 49 of the front panel 46 thus clears the underside of the slit 31, the resiliency of the hinge provided by the perforated line 47 pivots the front panel 46 forwardly toward the end panel 24. The terminal end 49 of the front panel thus moves out of registry with the slit 31 and becomes lodged in the corner on the inner side of the fold line 16*a* where the flap 29 joins the end panel. This lodgement of the terminal end 49 thus captures the locking tab 38 on the outside of the box 32, holding the end panel securely over the end of the box as seen in FIG. 2*d*. It is now impossible to withdraw the locking panel 50 from the slit 31, or otherwise to disengage the locking tab 38 from the remainder of the box, without cutting or tearing some visible portion of the locking tab or otherwise mutilating part of the box such that tampering with the box becomes evident to the onlooker.

With the box 32 closed, the combined presence of the corner flaps 26, the secondary end panel 75, and the end panel 24 juxtaposed with each other across the end of the box effectively prevents anyone from prying or bending back the end panel in an attempt to see the contents of the box. The shank 39 of the locking tab 38 extends from the perforated line 40 to the slit 31 in the flap 29, and keeps the end panel 24 secured in place across the end of the box. Even if a person somehow manages to bend that end panel somewhat back from the end of the box, by deforming the end panel, the secondary end panel 75 remains in place blocking visual and physical access to the interior of the box.

Because the slit 31 in the flap 29 is longer than the widths of the central panel 44 and the front panel 46 making up the locking panel 50, that locking panel passes through the slit without interference with the flanges 86 at each end of the central panel. The accordion-folded central panel 44 and front panel 46 make a tight fit while being pushed downwardly through the slit 31, but that slit preferably is long enough to permit the flap portions on either side of the slit to temporarily deform or deflect as the locking panel 50 moves through the slit.

Figure 3:
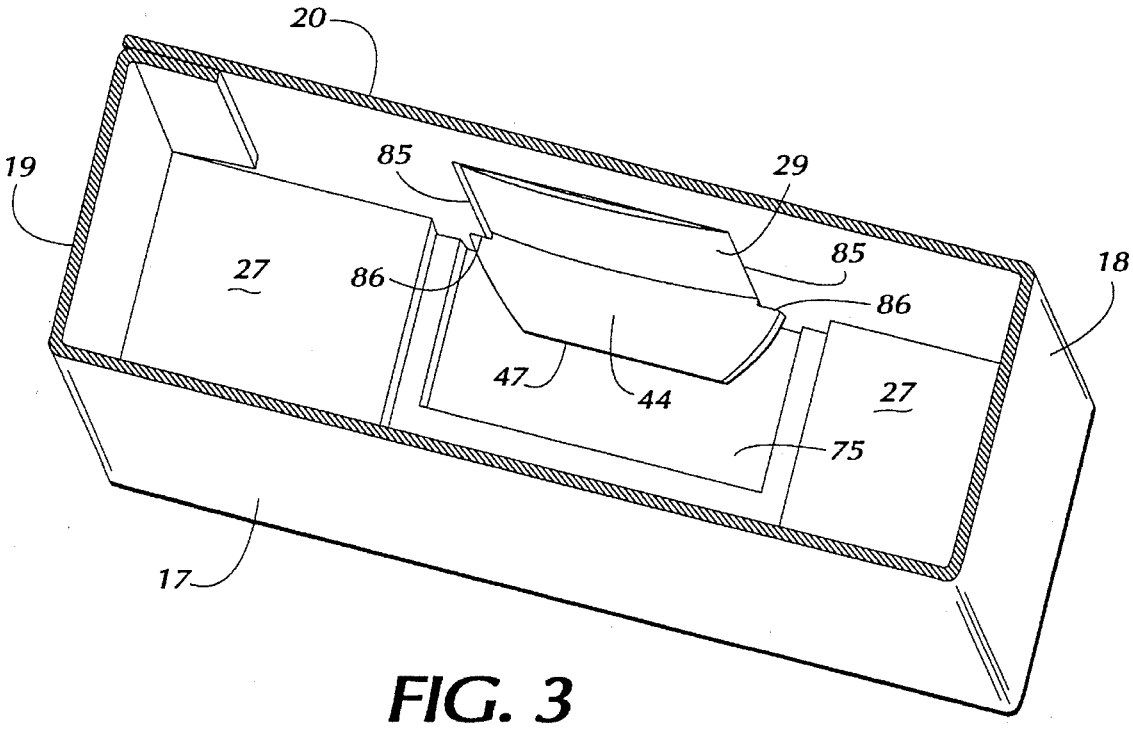
FIG. 3 is a fragmentary pictorial view of the closed box in FIG. 2*d*, showing the locking flanges engaging a panel surface within the box.

Although the flanges 86 on the central panel 44 can pass through the slit 31 without interfering with the ends of that slit, the lateral extent of those flanges is greater than the corresponding width of the open space 37 remaining when the locking tab 38 is turned upwardly from the plane of the top panel 20. FIG. 1 best shows this relationship between the spacing between the parallel cut lines 41 that define the width of the remaining space 37 in the top panel 20, and the lateral extent of the flanges 86 which extend outwardly adjacent to the shank 39. Because the flanges 86 extend beyond the sides 85 of the remaining space 37, those flanges deformably pass over the sides as the locking tab 38 is pressed downwardly through the slit 31 to lock the box closed. The leading edge 89 of each flange 86 preferably is curved or angled outwardly from the score line 47 to the flange, to assist the flanges in moving past the interfering sides 85. Once those flanges have moved past the sides, each flange engages the underside of the top panel 20 as seen in FIG. 3, effectively securing the locking tab 38 in place within the box 32 and preventing any nondestructive withdrawal of that locking tab.

The flanges 86 on the central panel 44 provide an additional measure of security for the locked box. If a person attempts to jimmy open the folded locking panel 50 by inserting a blade or other thin tool through the slit 31 of the locked box, either of two results is likely to occur. The first likelihood is that the person probing with the thin tool will tear apart the perforated line 47, thereby separating the central panel 44 from the front panel 46 of the locking tab 38. If that separation takes place, the terminal end 49 of the front panel 46 no longer remains engaging the inside corner formed by the fold line 16*a*. However, the flanges 86 on the central panel 44 continue to engage the underside of the top panel 20 at the sides 85 of the space 37, so that the locking tab 38 continues to hold the flap 29 secured over the end of the box as shown in FIG. 2*d*.

The second possible result of probing with a thin tool is that the person actually may succeed in unfolding the locking panel 50 without rupturing the perforated line 47. This possibility is unlikely, particularly in boxes according to the present invention and fabricated from relatively stiff material such as corrugated board. Nonetheless, if unauthorized probing does succeed in moving the front panel 46 downwardly within the locked box without rupturing the perforated line 47, the flanges 86 of the central panel 44 again remain in place engaging the top panel 20 at the sides 85. This engagement prevents withdrawing the locking tab from the box, so that the box remains closed and locked.

The perforated line 40 securing the locking tab 38 to the top panel 20 provides still another measure of security. That perforated line 40 is constructed to provide a predetermined amount of weakness to the hinge or fold line joining the locking tab 38 to the front panel. This predetermined amount of weakness does not rupture or tear during normal operation of the locking tab, namely, turning the locking tab upwardly from the plane of the front panel 20 to begin locking the box, and the other normal manipulations of the locking tab as previously described. However, both the perforated line 40 connecting the shank 39 to the front panel, and the perforated line 47 connecting the central panel 44 to the shank, are designed to tear apart, separating the respective elements of the locking tab, in response to applied force exceeding a predetermined amount, especially a tearing force applied to an end of either perforated line.

The selective separability of the perforated lines 40 and 47 make it virtually impossible to tamper with the locking tab without rupturing some part of that locking tab, thereby leaving irreparable evidence of tampering with the locked box. For example, if a person attempts to open the box by sliding a thin blade between the shank 39 and the flap 29 of the closed box and then prying upwardly on the shank to withdraw the locking panel 50 from the slit 31, that prying movement exerts a tearing force on the perforation lines 40 and 47. At least one of those perforation lines will rip apart in response to force less than the amount that could forcibly pull the flanges 86 upwardly past their engagement with the edges 88 on the top panel 20. The tampering person has opened the box, but has done so in a destructive manner providing clear evidence of tampering with the locked box. The selective separability of the perforated lines 40 and 47 also provides the added advantage of making it easier for an authorized person to open the locked box. The perforations 95 on the shank 39 of the locking tap 38 provide further protection from undetected tampering, because those perforations also may tear in response to lifting or tearing forces applied to the locking tab.

The perforations 92 on the end panel 24 assist the intentional opening of the box 32. By grasping an edge of the slit 31 at an end of the locked box and pulling the flap 29 downwardly and away from the locking tab 38, a portion of the end panel 24 becomes separated between the pairs of perforations 92. The torn end panel 24 thus releases the locking tab from locking engagement with the flap and permits opening the end panel for access to the interior of the box.

It will be understood that the foregoing relates only to a preferred embodiment of the present invention and that numerous changes and modifications therein may be made without departing from the spirit and scope of the invention as defined in the following claims.

We claim:

1. A box that is lockable when closed, the box comprising:

a plurality of body panels interconnected to form a box;

an end panel connected to a first said body panel to selectively close an end of the box, and having a flap extending to overlap an end of a second said body panel when the end panel closes the end of the box;

a slit located in the flap of the end panel;

an open region in the end of the second body panel and substantially covered by the flap when overlapping the second body panel, so as to position the slit overlaying the open region;

a locking tab connected to the second body panel adjacent the overlapping location occupied by the flap;

said locking tab having a fold line defining a locking panel for insertion in the slit;

the locking panel having a central portion and a fold line defining a terminal portion selectably foldable to lie alongside the central portion with the fold line thereby forming a leading edge of the folded locking panel;

the locking panel with the terminal portion so folded being aligned for insertion by the leading edge through the slit and the open region into the box whereat the terminal portion partially unfolds to abut the end panel, thereby locking the end panel to the second body panel to form a closed box; and a flange positioned on the locking tab to engage a surface of the second body panel adjacent the open region as the locking panel is inserted through the slit and prevent withdrawing the central portion from the open region after the end panel is locked to the second body panel to close the box.

2. The box as in claim 1, wherein the flange is on the central panel of the locking box.

3. The box as in claim 1, wherein the locking tab is connected to the second body panel by a selectably separable region of predetermined weakness allowing the locking tab to separate from the body panel in response to attempting to withdraw the locking tab from the slit after the end panel is locked, so that the attempted withdrawal becomes evident.

4. The box as in claim 3, wherein:

the locking tab has at least one additional region of predetermined weakness spaced from the connection to the second body panel and operative to separate in response to force applied onto the locked end panel.

5. The box as in claim 3, wherein the selectably separable region comprises a perforated region joining the locking tab to the second body panel.

6. The box as in claim 1, further comprising:

a secondary end panel extending outwardly from the second body panel and foldable to close the end of the box.

7. The box as in claim 1, wherein the slit is longer than the width of the open region overlaid by the slit so that the folded locking panel can pass through the slit without engaging the flange on an end of the slit, when the locking panel is inserted through the slit into the open region.

8. The box as in claim 1, wherein:

the flange is one of two flanges on opposite sides of the central portion and operative to engage respective surfaces of the second body panel on opposite sides of the open region as the locking panel is inserted through the slit.

9. The box as in claim 1, further comprising:

a region of predetermined weakness formed in the end panel and disposed substantially perpendicular to the slit located in the flap of the end panel so that the end panel can tear along the region of weakness therein; in response to a pulling force exerted on the flap at one side of the slit, whereby the locked box is openable.

10. A box that is lockable when closed, the box comprising:

a plurality of body panels interconnected to form a box;

an end panel connected to a first said body panel to selectively close an end of the box, and having a flap extending to overlap an end of a second said body panel when the end panel closes the end of the box;

a secondary end panel extending outwardly from the second body panel and foldable to close the end of the box in substantially parallel relation to the end panel, so as to prevent a person from seeing inside the box by pulling back the end panel from the end of the box;

a slit located in the flap of the end panel;

an open region in the end of the second body panel and substantially covered by the flap when overlapping the second body panel, so as to position the slit overlaying the open region;

a locking tab connected to the second body panel adjacent the overlapping location occupied by the flap;

said locking tab having a fold line defining a locking panel for insertion in the slit;

the locking panel having a central portion and a fold line defining a terminal portion selectably foldable to lie alongside the central portion with the fold line thereby forming a leading edge of the folded locking panel;

the locking panel with the terminal portion so folded being aligned for insertion by the leading edge through the slit and the open region into the box whereat the terminal portion partially unfolds to abut the end panel, thereby locking the end panel to the second body panel to form a closed box; and a flange positioned on the central portion of the locking panel to engage a surface of the second body panel adjacent the open region as the locking panel is inserted through the slit and prevent withdrawing the central portion from the open region after the end panel is locked to the second body panel to close the box.

11. The box as in claim 10, wherein:

the secondary end panel is foldably connected to the end of the second body panel;

the locking tab is formed in one part in the second body panel and in another part in the secondary end panel;

the locking tab is connected to the second body panel along a fold line so that the locking tab becomes deflected outwardly from the second body panel to reveal the open region formerly occupied by the locking tab; and the flange extends outwardly from a side of the locking tab beyond the open region and thus extends beyond an edge of the second body panel defining the open region, so that the flange deformably passes beyond the edge and is there operative to prevent withdrawing the locking tab from the open region.

12. A one-piece blank for producing a box that is tamper-evident, the blank comprising:

two pairs of alternately disposed rectangular body and side panels connected on mutually parallel fold lines;

a pair of end panels, each end panel connected to one such body panel on mutually parallel second fold lines orthogonal to the first-mentioned fold lines;

at least one such end panel having a flap extending from an edge opposite to the connection to the one body panel and foldable relative to the one end panel along a fold line parallel to the second fold lines;

a slit located in the flap;

an open region in the other body panel and defined by edges on that other body panel, the open region being substantially covered by the flap of a box produced by the blank when the flap overlaps the other body panel to position the slit overlaying the open region;

a locking tab bendably connected, by a third fold line parallel to the second fold lines, to the other body panel;

the locking tab comprising a shank portion terminating in a locking panel having a central portion, and a front panel extending from a forward edge of the central portion and connected thereto by a tab fold line parallel to the third fold line;

the locking tab being located relative to the flap extending from the one end panel so that with the front panel folded upon the central portion to form a leading edge of the locking tab along the tab fold line and the folded locking tab inserted through the slit of the box produced from the blank, the front panel returns to a position inside the box such that a portion of the front panel abuts a surface of the flap and the end panel connected thereto, so that the one end panel of the box is locked to a body panel of the box to which the one end panel is not connected and cannot be withdrawn without severing the locking tab or otherwise producing visible evidence of tampering; and a flange extending outwardly from a side of the locking tab to engage an edge of the open region as the locking panel is inserted through the slit so as to prevent withdrawing the locking tab from the open region after the end panel is locked to the second other body panel to close the box.

13. The blank as in claim 12, wherein the flange is formed on the central panel of the locking tab.

* * * * *